US006244532B1

(12) United States Patent
Watanabe

(10) Patent No.: US 6,244,532 B1
(45) **Date of Patent: *Jun. 12, 2001**

(54) SYSTEM AND APPARATUS FOR WINDING A LIFTING CORD

(75) Inventor: Kelly A. Watanabe, Plano, TX (US)

(73) Assignee: BTX Holdings, Inc., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/082,263

(22) Filed: May 20, 1998

(51) Int. Cl.[7] ..... B65H 75/44; E06B 9/30
(52) U.S. Cl. ..... 242/399.1; 242/397; 160/171
(58) Field of Search ..... 242/397, 399.1, 242/615; 160/171

(56) References Cited

U.S. PATENT DOCUMENTS

| | | | | |
|---|---|---|---|---|
| 3,141,497 | | 7/1964 | Griesser | 160/170 |
| 4,623,012 | * | 11/1986 | Rude et al. | 160/171 |
| 4,955,421 | | 9/1990 | Torti | 160/243 |
| 5,070,927 | * | 12/1991 | Chen | 160/171 |
| 5,103,888 | | 4/1992 | Nakamura | 160/171 |
| 5,123,472 | | 6/1992 | Nagashima et al. | 160/170 |
| 5,178,200 | | 1/1993 | Hagen | 160/107 |
| 5,184,660 | | 2/1993 | Jelic | 160/171 |
| 5,318,090 | | 6/1994 | Chen | 160/171 |
| 5,328,113 | | 7/1994 | de Chevron Villette et al. | 242/388 |
| 5,645,118 | | 7/1997 | Lagarde | 160/170 |

* cited by examiner

*Primary Examiner*—John Q. Nguyen
(74) *Attorney, Agent, or Firm*—Theodore F. Shiells; Gardere Wynne Sewell LLP

(57) ABSTRACT

A system and apparatus for winding a lifting cord. The device comprises a rotatable shaft (14), a wrapping guide (22) and a winding drum (12) mounted on the rotatable shaft (14) such that the winding drum (12) rotates with the shaft (14) and is free to move axially along the shaft (14). One end of the lifting cord (24) is attached to the winding drum (12). The wrapping guide (22) is configured to engage the lifting cord (24) such that as the shaft (14) and winding drum (12) rotate, the lifting cord (24) wraps around the winding drum (12) in even turns without overlapping and forces the winding drum (12) to travel axially along the shaft (14).

26 Claims, 4 Drawing Sheets

SYSTEM AND APPARATUS FOR WINDING A LIFTING CORD

FIELD OF THE INVENTION

The present invention relates generally to lifting mechanisms and more specifically to a system and apparatus for winding a lifting cord.

BACKGROUND OF THE INVENTION

Window coverings or blinds such as awnings, mini-blinds, Venetian blinds, or folded blinds generally have two or more lifting cords, one near each end of the blind. One end of each lifting cord is attached to the free end of the blind, while the other end is attached to the lifting mechanism. The lifting mechanism may be as simple as a pull cord and clutch or as complex as a remote controlled motor. No matter what the lifting mechanism is, the owner of the blind desires that the free end of the blind remain level during the winding and unwinding of the blind.

Keeping the free end of the blind level is important both for esthetic and mechanical reasons. If the free end of the blind does not remain level, the most expensive decor may appear cheap. Moreover, this may be a source of irritation for the owner or operator. In addition, the chance that the lifting mechanism will jam or that there will be uneven wear on the mechanism increases when the free end of the blind does not remain level. These problems are multiplied as the length of the blinds increases or as the blinds get wider, which requires more lifting cords to be added.

SUMMARY OF THE INVENTION

The present invention provides a system and apparatus for winding a lifting cord. The device comprises a rotatable shaft, a wrapping guide and a winding drum mounted on the rotatable shaft such that the winding drum rotates with the shaft and is free to move axially along the shaft. One end of the lifting cord is attached to the winding drum. The wrapping guide is configured to engage the lifting cord such that as the shaft and winding drum rotate, the lifting cord wraps around the winding drum in even turns without overlapping and forces the winding drum to travel axially along the shaft. This means that the free end of the blind will remain level during winding and unwinding.

The present invention also provides a system for winding two or more lifting cords. The system comprises an elongated frame having a plurality of openings through which a top end of each lifting cord enters the elongated frame, a shaft rotatably fixed within the elongated frame, two or more winding drums mounted on the shaft, and two or more wrapping guides mounted within the elongated frame. Each winding drum is mounted above each opening in the elongated frame such that each winding drum rotates with the shaft and each winding drum is free to move axially along the shaft. Each lifting cord enters the elongated frame through one of the openings and attaches to one of the winding drums. Each wrapping guide is configured to engage one of the lifting cords such that as the shaft and winding drums rotate, the lifting cords wrap around the winding drums in even turns without overlapping and force the winding drums to travel axially along the shaft.

Other features and advantages of the present invention shall be apparent to those of ordinary skill in the art upon reference to the following detailed description taken in conjunction with the accompanying drawings.

BRIEF DESCRIPTION OF THE DRAWINGS

The above and further advantages of the invention may be better understood by referring to the following description in conjunction with the accompanying drawings, in which.

DETAILED DESCRIPTION

Figure 1A:
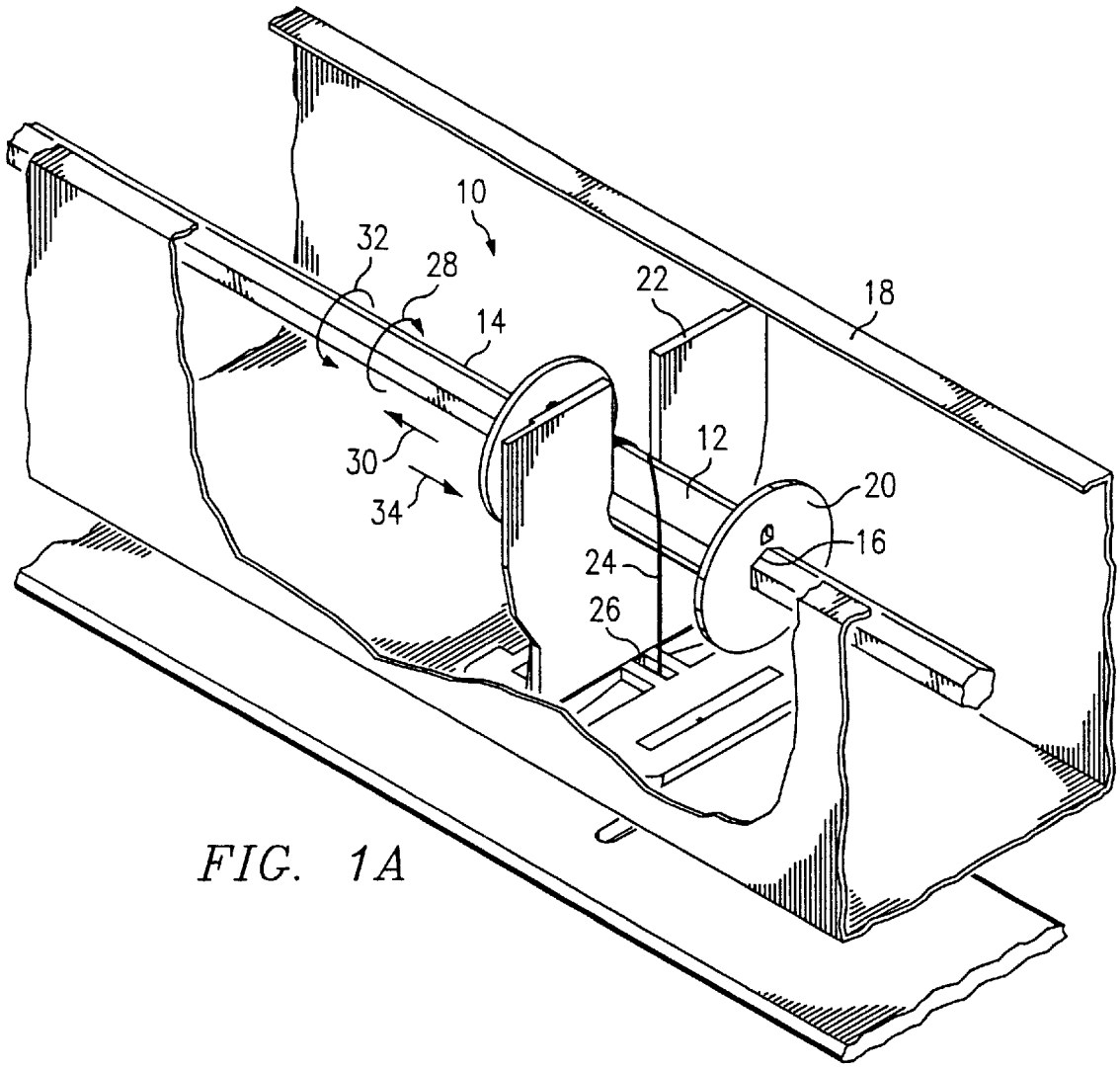
FIGS. 1A–1D illustrate a winding device in accordance with various embodiments of the present invention.
Figure 1B:
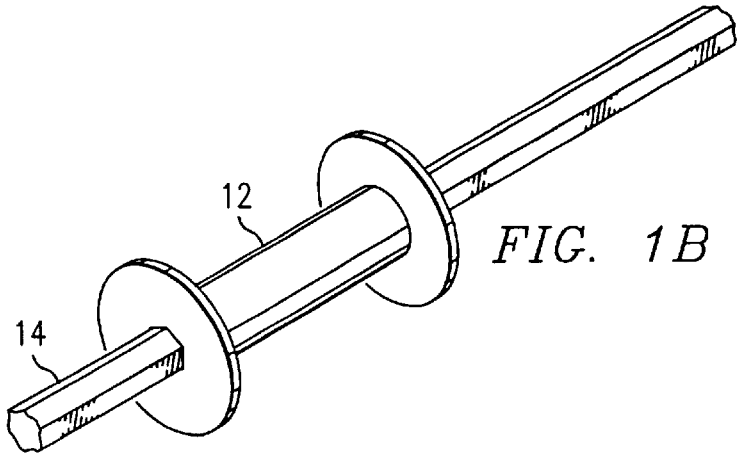
Figure 1C:
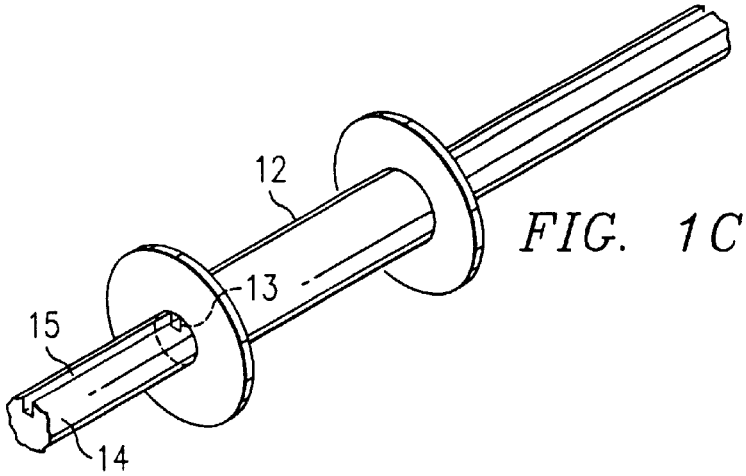

Referring now to the Drawings, and first to FIG. 1A, a winding device in accordance with one embodiment of the present invention is shown and generally denoted as 10. A winding drum 12 is mounted on a shaft 14 such that the winding drum 12 rotates with the shaft 14 and is free to move axially along the shaft 14. The winding drum 12 has a hole or channel 16 that engages the shaft 14 and causes the winding drum 12 to rotate with the shaft 14. The winding drum 12, shaft 14 and hole 16 may be of any shape or configuration that allows the winding drum 12 to rotate with the shaft 14 and move axially along the shaft 14. For example, FIG. 1A illustrates the use of a hexagonal shaft 14 and hole 16. Alternatively, the shaft 14 and hole 16 may be square or octagonal as illustrated in FIG. 1B. A cylindrical shaft 14 may also be used, as illustrated in FIG. 1C, if the shaft 14 has an axial channel and the winding drum 12 has a guiding pin 15 within the hole 16 that engages the axial channel 15. Many other suitable alternatives may be successfully used.

The winding drum 12 is mounted within an elongated frame or head rail 18. The winding drum 12 may have a collar or flange 20 to prevent the lifting cord 24 from wrapping around the shaft 14 and the winding drum 12 from traveling past the wrapping guide 22. The winding drum 12 and the collar 20 may be a single molded part or may be separate parts that are attached together. For example, the winding drum 12 may be a cylindrical tube with a collar 20 mounted at each end with each collar 20 having a hole 16 though its center for engaging the shaft 14.

The wrapping guide 22 is mounted between the ends of the winding drum 12 such that the lifting cord 24 enters the elongated frame 18 through opening 26, which is on one side of the wrapping guide 22, and the lifting cord 24 is attached to an end of the winding drum 12 on the opposite side of the wrapping guide 22. As the shaft 14 and winding drum 12 rotate in direction 28, the lifting cord 24 is carried over the winding drum 12 to the other side of the wrapping guide 22 where the lifting cord 24 engages the wrapping guide 22 and forces the winding drum 12 to travel axially along the shaft 14 in direction 30. This ensures that the lifting cord 24 is wound on the winding drum 12 in even turns without overlapping, which causes the blind (not shown) to remain level during winding and unwinding. This is highly desirable for both esthetic and mechanical reasons. Similarly, as the shaft 14 and winding drum 12 rotate in direction 32, the weight of the blind or window covering (not shown) pulls the lifting cord 24 through opening 26 and forces the winding drum 12 to travel axially along the shaft 14 in direction 34. As will be described below in reference to FIG. 2, the winding device 10 may be configured such that the winding drum 12 travels in direction 34 when the shaft 14 and winding drum 12 rotate in direction 28, and travels in direction 30 when the shaft 14 and winding drum 12 rotate in direction 32.

The present invention reduces the complexity of both manual and motorized lifting devices. For example, the winding rate is no longer dependent on the diameter of the shaft 14 because the lifting cord 24 is wound on the winding drum 12 instead. Thus the shaft 14 diameter may be reduced, which in turn reduces cost and weight. In addition, the present invention does not utilize a large number of parts or extremely complex parts that increase cost and the likelihood of either improper operation or complete failure. In addition, the present invention also works well regardless of whether the blind is manually or motor operated.

Similarly, the raising and lowering rate of the lifting cord 24 does not have to be defined by the diameter of the shaft 14. Accordingly, if two customers want different winding rates on the same blinds, or the material or the location dictates different rates on the same blinds, the manufacturer can utilize the same motor for both situations and need only vary the diameter of the winding drum 12.

Figure 1D:
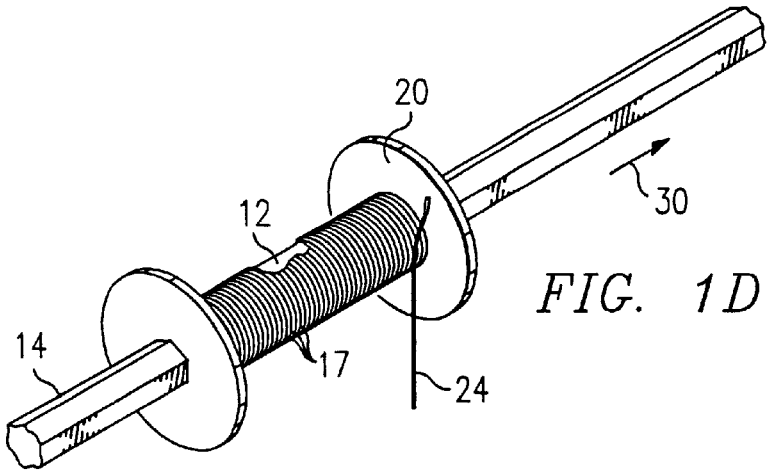

In situations where light weight blind or window coverings are used, the lifting cord 24 may be looped around the winding drum 12 before engaging the wrapping guide 22. In such a case, the lifting cord 24 is carried over the winding drum 12 and wraps around the winding drum at least once before the lifting cord 24 is carried to the other side of the wrapping guide 22 where the lifting cord 24 engages the wrapping guide 22 and forces the winding drum 12 to travel axially along the shaft 14 in direction 30. Another alternative in light weight applications is the use of a winding drum 12 that has exterior threads 17 as illustrated in FIG. 1D. These exterior threads 17 provide the same function as the wrapping guide 22 and force the winding drum 12 to travel axially along the shaft 14 in direction 30 as the lifting cord 24 engages the threads 17.

Figure 2:
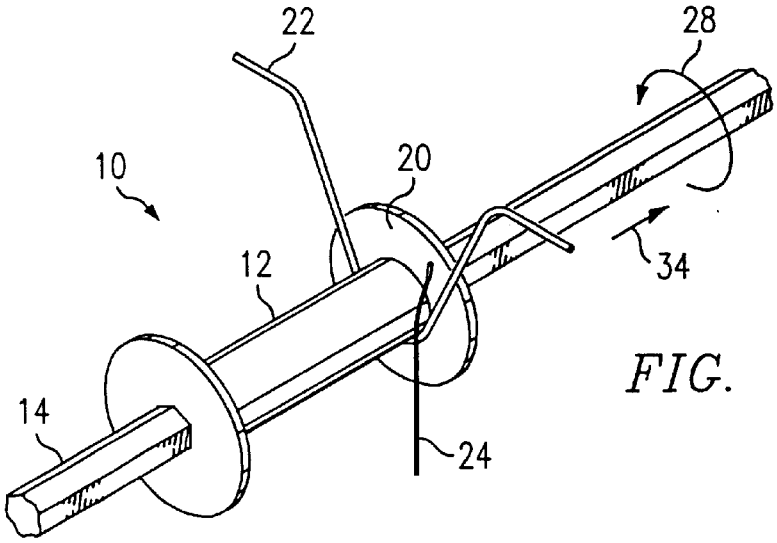
FIG. 2 illustrates an alternative wrapping guide in accordance with one embodiment of the present invention.

Now referring to FIG. 2, an alternative wrapping guide 22 in accordance with one embodiment of the present invention is illustrated. This wrapping guide 22 functions in the same manner as described in reference to FIG. 1A. Accordingly, the wrapping guide 22 may comprise any configuration or combination of elements that cause the winding drum 12 to travel axially along the shaft 14 as the shaft 14 and winding drum 12 rotate and the lifting cord 24 engages the wrapping guide 22. FIG. 2 also shows that the winding drum 12 may be configured to travel in direction 34 when the shaft 14 is rotated in direction 28 by attaching the lifting cord 24 to the other end of the winding drum 12 as compared to FIG. 1A and positioning the lifting cord 24 on the other side of the wrapping guide 12 as compared to FIG. 1A. This provides great flexibility during complex or special installations because all the winding drums 12 within a particular blind do not have to travel along the shaft 14 in the same direction.

Figure 3:
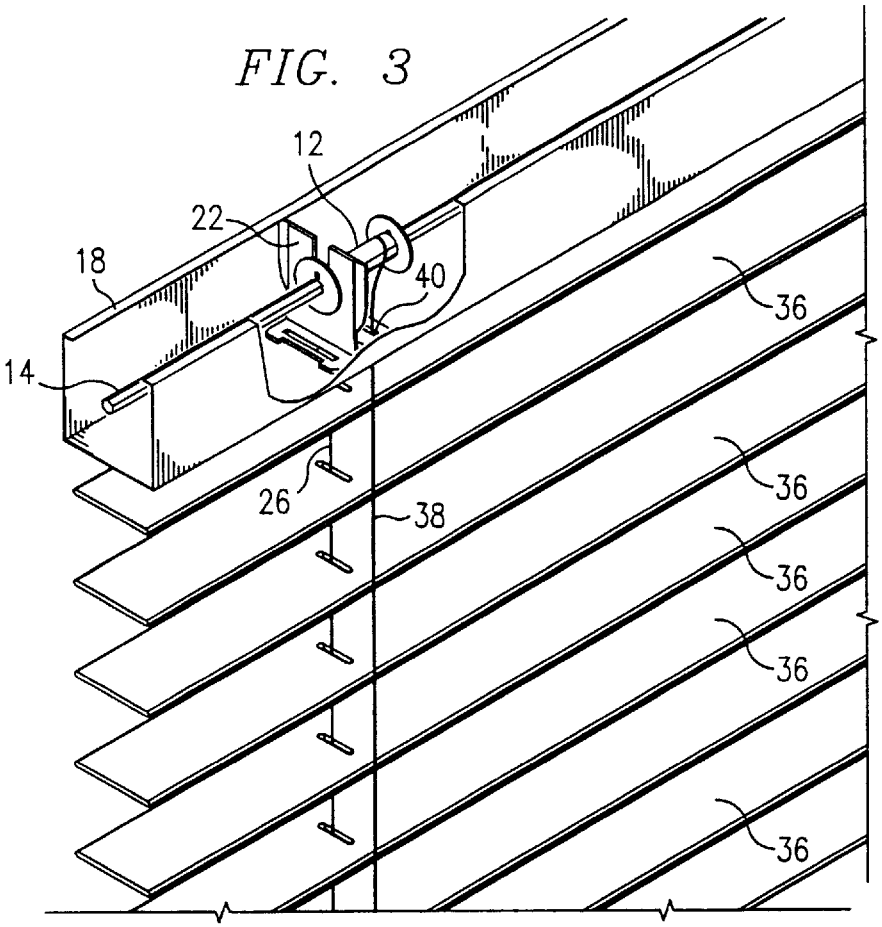
FIG. 3 illustrates a winding device in accordance with one embodiment of the present invention with a blind and tilt cord.
Figure 4:
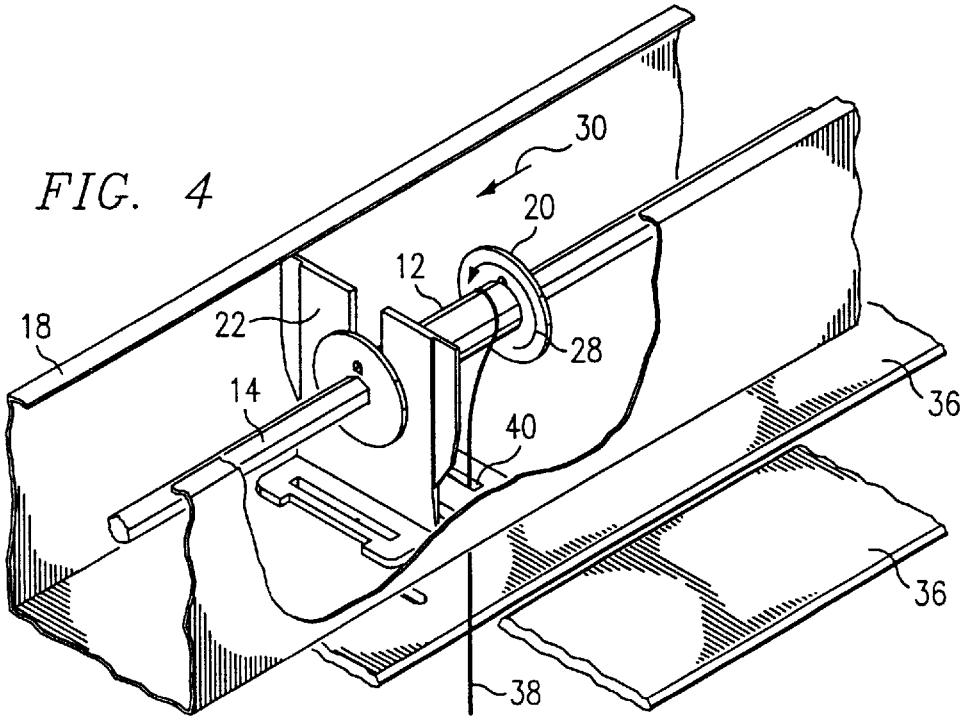
FIG. 4 is a close up view of the winding device in FIG. 3.

Now referring to FIGS. 3 and 4, a winding device in accordance with one embodiment of the present invention is illustrated with several blinds 36 and a tilt cord 38. The tilt cord 38 is used to rotate the blinds 36 from an open position, which is substantially horizontal, to a closed position, which is almost vertical. The tilt cord 38 enters the elongated frame 18 through opening 40 and is frictionally attached to the winding drum 12 such that as the winding drum 12 rotates, the tilt cord 38 rotates with the winding drum 12 until the blinds 36 are fully opened or closed at which time the tilt cord 38 stops rotating even if the winding drum 12 continues to rotate.

Figure 5:
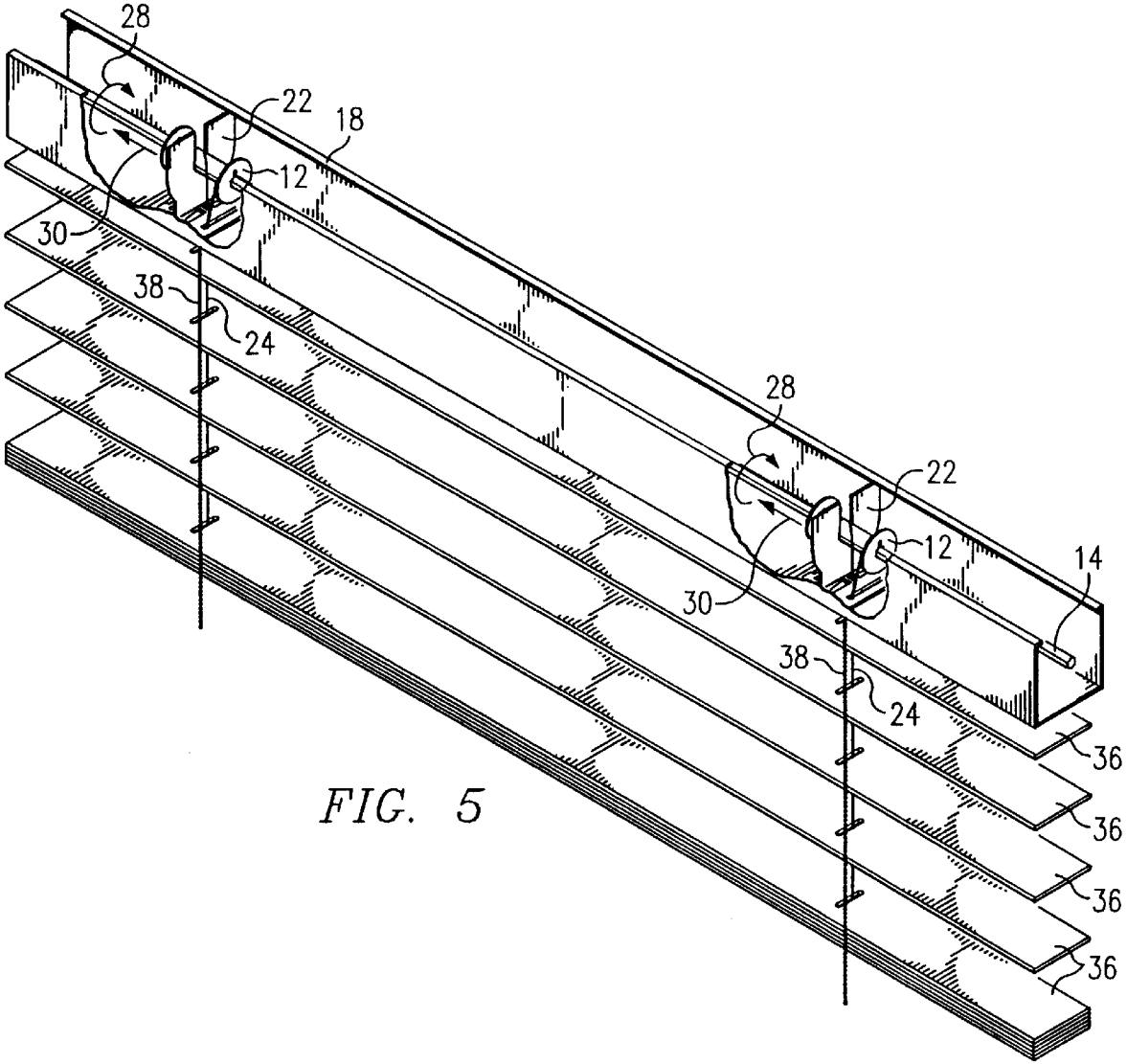
FIG. 5 illustrates one end of a blind as it is being raised using one embodiment of the present invention.

Now referring to FIG. 5, a blind is illustrated as it is being raised using one embodiment of the present invention. As the shaft 14 is rotated in direction 28, the lifting cords 24 engage the wrapping guides 22 and are wrapped around the winding drums 12. This forces each winding drum 12 to travel in direction 30 and the blinds 36 to be raised. After the tilting cords 38 have opened the blinds 36, the tilting cords 38 stop rotating with the winding drums 12.

Although preferred embodiments of the invention have been described in detail, it will be understood by those skilled in the art that various modifications can be made therein without departing from the spirit and scope of the invention as set forth in the appended claims.

What is claimed is:

1. A device for winding a lifting cord, the device comprising:

a rotatable shaft;

a winding drum mounted on the rotatable shaft such that the winding drum rotates with the shaft and is free to move axially along the shaft, the lifting cord having a load-supporting length oriented generally perpendicular to the axis of said rotatable shaft and leading to one end attached to the winding drum; and a wrapping guide disposed between said load-supporting length and said one end of said cord so that said cord runs from said load-supporting length on one side of said guide and over said drum to the other side of said guide which is configured to engage the lifting cord such that as the shaft and winding drum rotate, the lifting cord wraps around the winding drum on said other side of said guide in even turns without overlapping and forces the winding drum to travel axially along the shaft.

2. The device as recited in claim 1, wherein the winding drum further comprises a collar at each end of the winding drum that prevents the winding drum from traveling beyond the wrapping guide in either direction.

3. The device as recited in claim 1, wherein the wrapping guide is substantially perpendicular to the axis of the winding drum.

4. The device as recited in claim 1, wherein there are threads on the exterior of the winding drum to facilitate winding.

5. The device as recited in claim 1, wherein:

the shaft is polygonal; and the winding drum comprises a cylindrical tube and a collar mounted on each end of the cylindrical tube, each collar having a hole through its center adapted for engaging the polygonal shaft.

6. The device as recited in claim 5, wherein the cylindrical tube and the collar mounted on each end of the cylindrical tube are a molded as a single piece.

7. The device as recited in claim 1 wherein the shaft is hexagonal; and the winding drum comprises a cylindrical tube and a collar mounted on each end of the cylindrical tube, each collar having a hole through its center adapted for engaging the hexagonal shaft.

8. The device as recited in claim 7, wherein the cylindrical tube and the collars mounted on each end of the cylindrical tube are molded together as a single piece.

9. The device as recited in claim 1, wherein:

the shaft is cylindrical in cross-section and has a channel axially along the shaft; and the winding drum comprises a cylindrical tube and a collar mounted on each end of the cylindrical tube with at least one of the collars engaging the channel such that the winding drum will rotate with the shaft.

10. The device as recited in claim 9, wherein the cylindrical tube and the collars mounted on each end of the cylindrical tube are molded together as a single piece.

11. The device as recited in claim 1, wherein the shaft is hollow.

12. The device as recited in claim 1, wherein the winding drum is a spool.

13. A device for winding a lifting cord within an elongated frame, the elongated frame having an opening through which a top end of the lifting cord enters the elongated frame, the device comprising:

a polygonal shaft rotatably fixed within the elongated frame;

a winding drum mounted on the shaft above the opening in the elongated frame such that the winding drum rotates with the shaft and the winding drum is free to move axially along the shaft;

the lifting cord having a load-supporting length generally perpendicular to the axis of said shaft leading to one end attached to the winding drum;

the winding drum comprising a cylindrical tube and a collar mounted on each end of the cylindrical tube, such that a hole adapted for engaging the polygonal shaft is disposed through the center of at least one of the collars; and a wrapping guide mounted within the elongated frame between the opening where the lifting cord enters the elongated frame and one of the collars of the winding drum where the top end of the lifting cord is attached, such that as the shaft and winding drum rotate, the lifting cord is carried from one side of said wrapping guide over the winding drum to the other side of the wrapping guide where the lifting cord engages the wrapping guide and forces the cord to wrap onto said winding drum on said other side of said wrapping guide and forces the winding drum to travel axially along the shaft.

14. A system for winding two or more lifting cords, comprising:

an elongated frame having a plurality of openings through which a top end of each lifting cord enters the elongated frame;

a shaft rotatably fixed within the elongated frame;

two or more winding drums mounted coaxially along the axis of the shaft, each winding drum mounted above each opening in the elongated frame such that each winding drum rotates with the shaft and each winding drum is free to move axially along the shaft independently of the axial movement of the other winding drums respectively;

each lifting cord having a load-supporting length generally perpendicular to the axis of said shaft entering the elongated frame through one of the openings and leading to one end which attaches to one of the winding drums; and two or more wrapping guides mounted within the elongated frame and each wrapping guide disposed between said load-supporting length and said one end of said cord and configured so that each respective cord runs from said load-supporting length on one side of the respective guide over said drum to the other side of said guide to engage the other side of said guide such that as the shaft and winding drums rotate, the lifting cords wrap around the winding drums on said other side of their respective guides in even turns without overlapping and forces the winding drums to travel axially along the shaft.

15. The system as recited in claim 14, further comprising a motor drive for rotating the shaft.

16. The system as recited in claim 14, wherein each winding drum further comprises a collar at each end of the winding drum that prevents the lifting cord from wrapping around the shaft.

17. The system as recited in claim 14, wherein each wrapping guide is substantially perpendicular to the axis of the winding drum.

18. The system as recited in claim 14, wherein there are threads on the exterior of the winding drums to facilitate winding.

19. The system as recited in claim 14, wherein:

the shaft is polygonal; and each winding drum comprises a cylindrical tube and a collar mounted on each end of the cylindrical tube, each collar having a hole through its center adapted for engaging the polygonal shaft.

20. The system as recited in claim 19, wherein the cylindrical tube and the collars mounted on each end of the cylindrical tube are molded together as a single piece.

21. The system as recited in claim 14, wherein:

the shaft is polygonal in cross-section; and each winding drum comprises a cylindrical tube and a collar mounted on each end of the cylindrical tube, such that a hole for engaging the polygonal shaft is disposed through the center of at least one of the collars.

22. The system as recited in claim 21, wherein the cylindrical tube and the collars mounted on each end of the cylindrical tube are molded together as a single piece.

23. The system as recited in claim 14, wherein:

the shaft is cylindrical and has a channel axially along the shaft; and each winding drum comprises a cylindrical tube and a collar mounted on each end of the cylindrical tube with at least one of the collars engaging the channel such that the winding drum will rotate with the shaft.

24. The system as recited in claim 23, wherein the cylindrical tube and the collars mounted on each end of the cylindrical tube are molded together as a single piece.

25. The system as recited in claim 14, wherein the shaft is hollow.

26. The system as recited in claim 14, wherein each winding drum is a spool.

* * * * *